United States Patent [19]

Achtmann et al.

[11] 4,060,789

[45] Nov. 29, 1977

[54] MULTIPLE SLIDE RESISTOR

[75] Inventors: Walfried Achtmann, Bad Neustadt, Saale; Gerhard Hochgesang, Lebenhan, both of Germany

[73] Assignee: Preh-Elektrofeinmechanische Werke - Jakob Preh Nachf, Bad Neustadt, Salle, Germany

[21] Appl. No.: 698,022

[22] Filed: June 21, 1976

[30] Foreign Application Priority Data

June 21, 1975 Germany ..... 7519719

[51] Int. Cl.[2] ..... H01C 10/44

[52] U.S. Cl. ..... 338/183; 338/160; 338/176

[58] Field of Search ..... 338/128, 118, 130, 160, 338/165, 167, 171, 176, 183, 184, 188

[56] References Cited

U.S. PATENT DOCUMENTS

| | | | |
|---|---|---|---|
| 3,509,509 | 4/1970 | Rapisarda | 338/183 X |
| 3,566,330 | 2/1971 | Ichikawa et al. | 338/183 X |
| 3,639,880 | 2/1972 | Oka | 338/183 |
| 4,005,381 | 1/1977 | Klug | 338/183 X |

FOREIGN PATENT DOCUMENTS

| | | | |
|---|---|---|---|
| 2,240,728 | 8/1972 | Germany | 338/176 |

*Primary Examiner*—C. L. Albritton
*Attorney, Agent, or Firm*—Wigman & Cohen

[57] ABSTRACT

A multiple slide resistor suitable for use as a tandem resistor in a stereo system is disclosed. The slide resistor comprises a housing having a slide slot in which a slide bar is arranged to slide along a guide rail. The resistance and collector elements of each resistor are mounted upon a conductive layer on one side of a base plate which forms a closure for the housing. A shielding wall is provided between the resistors for electrically isolating them. The wall is electrically connected to the conductive layer of the base plate so as to achieve a desired cross talk attenuation.

5 Claims, 4 Drawing Figures

MULTIPLE SLIDE RESISTOR

BACKGROUND OF THE INVENTION

This invention relates to a multiple slide resistor provided with a base plate that forms a bottom closure of a resistor housing equipped with a slide slot, and upon which both the resistance elements and the collector elements associated with them are attached in such a way that each resistance unit is isolated electrically from the other by means of shielding. The multiple slide resistor is further provided with a movable slide element common to the resistors and upon which a plurality of brush spring pairs corresponding to the number of resistors is fastened to produce an electrical connection between the resistance element and the collector element of a particular resistor.

Multiple slide resistors with a common slide element are used principally in stereo systems in the form of a pair of tandem resistors. Apart from the need for good synchronism of both the resistors on the order of 3 db deviation or less, there is also the need for a high cross-talk attenuation between the two resistors. For this reason, the two resistors are separated from one another by a shielding.

There is a known slide resistance with a box-like metal housing. The open end of the box is closed by means of a metal lid having a slide slot. The collector and resistance strips are mounted on an insulating base that rests on the bottom of the resistor housing. The two units are separated from one another by means of a shielding wall, whereby said shielding wall is provided with soldering lugs. By interconnecting the soldering lugs, the base is locked together with the resistance and collector strips. Measurements have revealed that there is a certain cross-talk attenuation which, however, is too low for modern requirements in stereo tandem resistors. Furthermore, because of the fastening of the resistance and collector strips onto the base, assembly is much more time-consuming and therefore most costly, which is of particular significance in the case of these resistors, which are produced in large quantities.

In addition, in the case of one known tandem slide resistor, the housing consists of two identical halves inside which the resistance element and the collector element with their connecting lugs are fastened. The adjusting slide with the brush springs slides on a metal track that simultaneously serves as a shielding between the two resistor units. This slide resistor also fails to achieve the desired crosstalk attenuation of at least —60 db.

SUMMARY AND OBJECTS OF THE INVENTION

It is an object of this invention to eliminate these shortcomings and to provide a tandem slide resistor that will guarantee the required crosstalk attenuation while at the same time being simple and inexpensive to manufacture.

This problem is solved by the invention in that the base plate has a conductive layer at least on the side upon which the resistance and collector elements are located. The conductive layer is electrically connected with the shielding. Further, the height of the shielding is such that it projects above the brush spring pairs.

A first embodiment of the invention provides for a base plate that is copper-coated except for those points at which the connection contacts of the resistance and collector elements are located.

Another embodiment comprises a base plate coated on both sides and the backside of the plate is provided with conductor tracks for the connection contacts.

In another embodiment of the invention, the conductive coat and the shielding are electrically connected with the resistor housing.

A last embodiment is characterized in that the collector elements consist of support strips of insulating material having a conductive coating. Arranged in pairs, the collector elements are connected by means of at least one uncoated barrier and shielded by means of the shielding between them, whereby the barrier is clamped in a notch in the shielding.

BRIEF DESCRIPTION OF THE DRAWINGS

The invention and other features are explained in detail with reference to an embodiment illustrated in the drawings, wherein.

DETAILED DESCRIPTION OF A PREFERRED EMBODIMENT

Figure 1:
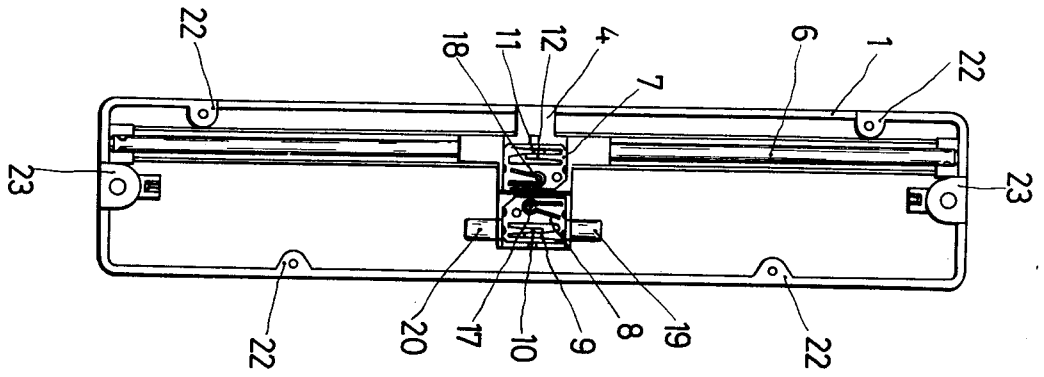
FIG. 1 shows a side view of an open slide resistor housing according to the invention.
Figure 2:
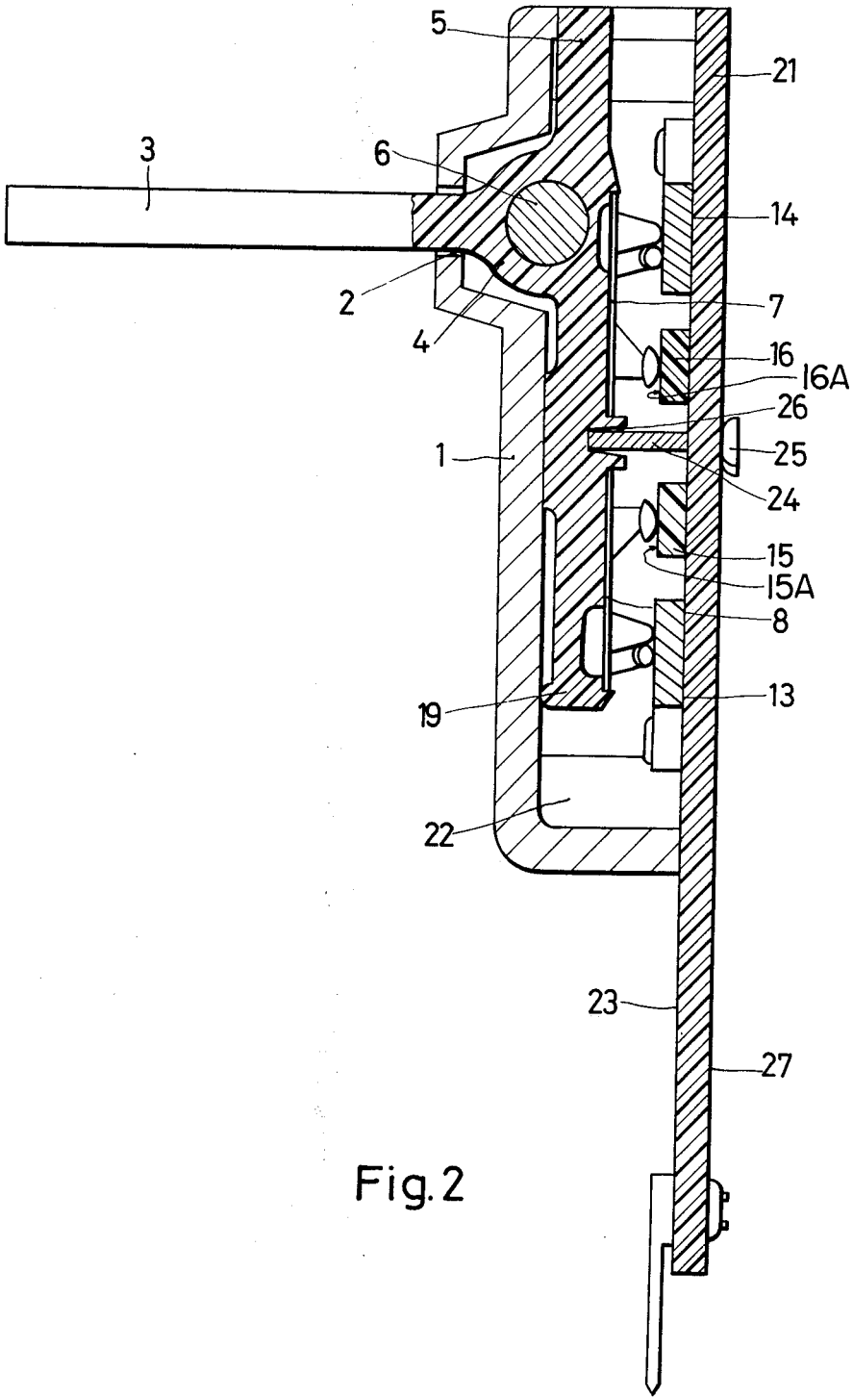
FIG. 2 shows a section through the slide resistor of the invention.

Referring to FIGS. 1 and 2, the reference numeral 1 designates an elongated metal resistor housing open on one side. An oblong slot 2 is hollowed out along the top of said housing. A lateral extension 3 of a slide bar 4 projects through said slot. After the slide resistor has been fastened in an instrument, a suitable activation button is attached to the extension 3, the free ends of which are springy snapping tongues. In the case of another embodiment, where the extension 3 is eliminated, another extension 5 of the slide bar 4 visible in FIG. 2 can be extended so that the slide resistor can be operated from another side and is thus suited for a different type of installation.

A cylindrical, elongated guide rail 6 is installed inside the housing 1. The plastic slide bar 4 is movable along this guide rail. Since the resistor in question is a tandem slide resistor, two pairs of brush springs 7 and 8 are attached to the slide bar, whereby the two contact springs 9, 10 and 11, 12 of each brush spring slide on the resistance elements 13, 14, while the contact springs 17, 18 rest on the collector elements 15, 16. Two lateral supports 19, 20 are formed on the slide bar 4 and contact the inner wall of the housing. The lid of the housing 1 consists of a base plate 21 secured to the housing reinforcements 22 by means of rivets. The two lateral embossments 23 serve to fasten the entire slide resistor to the instrument.

Figure 3:
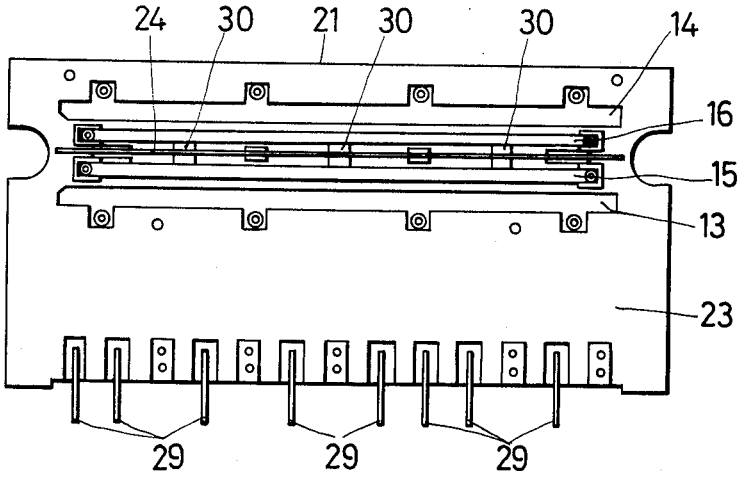
FIG. 3 shows a side view of the inventive base plate.

As FIG. 3 shows, the resistance elements 13, 14 and the collector elements 15, 16 are attached to the base plate 21 by means of rivets. Measurements have shown that the crosstalk attenuation is significantly greater if the base plate 21 is coated with a conductive coat 23 on the side on which the resistance and collector elements are located. The coating can be omitted on the spots where the rivets are located. The coating 23 is thus electrically connected with the housing 1. Between the two collector elements 15, 16, there is a shielding 24 standing vertically on the base plate 21. Fastening lugs 25 interconnect the shielding wall 24 with the base plate 21 after being fitted through slots in the base plate, so that the shielding wall is conductively connected with the coating 23 on the base plate. The height of the shielding wall 24 is such that the wall projects above the pairs of brush springs 7, 8. For this, an elongated groove 26 is hollowed out of the slide bar 4 into which the shielding wall 24 fits. As a result of this feature, the crosstalk attenuation is, as measurements have shown, significantly increased.

In the case of the embodiment illustrated in the drawings, the collector elements 15, 16 consist of support strips of insulating material having a conductive and highly abrasion-proof coating 15*a*, 16*a*. These strips, which lie adjacent one another, are connected by means of uncoated barriers 30. At the points where the barriers are located, the shielding wall is provided with notches through which the barriers project. In this way, the collector elements are fastened along their entire length at several points, in addition to the riveting points at their ends.

Figure 4:
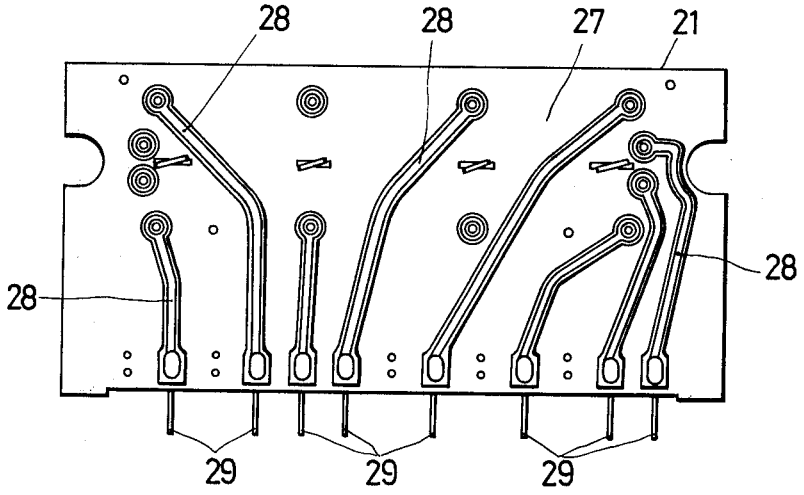
FIG. 4 shows a back view of the base plate of FIG. 3.

The reverse side of the base plate 21, in the case of this embodiment of the invention, also has a coating 27, as shown in FIG. 4. The rivet contact points of the resistance and collector elements are conducted to the soldering lugs 29 by means of conductor paths 28 separated by the coating. By means of these solderings lugs, which are soldered into a printed circuit board of the instrument, the electrical connection with the secondary electronic structural elements is produced. The operation of the slide resistor is thus parallel to and substantially coplanar with the instrument printed circuit board.

Also possible, of course, is an embodiment of the slide resistor in which the base plate 21 is arranged in a plane parallel to and spaced from the instrument printed circuit board. Soldering lugs of the printed circuit board are then bent and attached directly to the resistance and collector elements by means of rivets. A coating on the reverse side of the base plate would, in this embodiment, be superfluous.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. In a multiple slide resistor having a base plate that forms a bottom closure of a resistor housing provided with a slide slot, resistor units each including a resistance element and a collector element associated with said resistance element being attached to said base plate, each resistor unit being separated electrically from the other by means of a shielding, and a movable slide element common to all the resistor units and upon which a number of pairs of brush springs corresponding to the number of resistor units is fastened to produce an electrical connection between the resistance element and the collector element of each resistor unit, the improvement comprising said base plate having a conductive coating on at least the side thereof upon which the resistance and collector elements are located, said coating being electrically connected with the shielding, said shielding projecting above the pairs of brush springs.

2. The improvement according to claim 1, wherein the base plate is a copper-coated plate and wherein the coating of said base plate is omitted at the points where the electrical connections of the resistance and collector elements are located.

3. The improvement according to claim 1, wherein the base plate is a plate coated on both sides and wherein conductor paths and soldering lugs for the electrical connections of the resistance and collector elements are provided on the reverse side of the base plate.

4. The improvement according to claim 1, wherein the conductive coating and the shielding are electrically connected with the resistor housing.

5. The improvement according to claim 1, wherein the collector elements comprise support strips of insulating material having a conductive coating, said collector elements being arranged adjacent one another and connected to each other by at least one uncovered barrier, said collector elements being further electrically shielded by the shielding which is arranged between the collector elements, said shielding haveing a notch for receiving said barrier.

* * * * *